US005143227A

United States Patent [19]

Schubert

[11] Patent Number: 5,143,227

[45] Date of Patent: Sep. 1, 1992

[54] DISPLAY STAND FOR HANDGUNS

[76] Inventor: Alan Schubert, 6021 SW. 40th St., Miramar, Fla. 33023

[21] Appl. No.: 628,857

[22] Filed: Dec. 14, 1990

[51] Int. Cl.[5] ..... A47F 7/00

[52] U.S. Cl. ..... 211/64; 206/317

[58] Field of Search ..... 211/64, 13; 206/317

[56] References Cited

U.S. PATENT DOCUMENTS

| | | | |
|---|---|---|---|
| 945,520 | 1/1910 | Greenwood | 211/64 X |
| 3,031,069 | 4/1962 | Hirsch | 211/64 X |
| 3,345,027 | 10/1967 | Taylor | 211/64 |
| 4,050,662 | 9/1977 | Pickering | 211/64 X |
| 4,691,396 | 9/1987 | Hoffman | 211/64 X |

*Primary Examiner*—Robert W. Gibson, Jr.

[57] ABSTRACT

A free-standing handgun display stand, having one or more rectangular shaped sections for positioning handguns, with a trapezoidal shaped trigger guard receiving slot, or slots, one for each handgun positioning section, sized to maintain said handgun in an in-use position, with said handgun angled slightly. The display has rectangular support sections, adjacent to, and running perpendicular to, each handgun positioning section, and rectangular unit expansion slots at each end of the display, each slot being equal in width to the thickness of the display stand manufacturing material, one slot extending from the top, halfway to the bottom of the display stand, the other unit expansion slot extending from the bottom, halfway to the top of the display, in a manner that one of the expansion slots will mate with a unit expansion slot from another handgun display of the same, creating a continual display as desired.

3 Claims, 2 Drawing Sheets

DISPLAY STAND FOR HANDGUNS

This invention relates to a stand for displaying handguns, in firearms dealers', or collectors', showcases, or on shelves or tables at a gun show or exhibition.

In visiting numerous firearms dealers' stores, and gun shows, I have noticed that most dealers and collectors display their handguns by either propping them up with clothespins or shotgun shells, laying them directly on their shipping boxes, or by simply laying them flat in the showcases, on the shelves, or on the tables.

My invention is a stand, intended to enhance and facilitate the displaying of most styles and makes of handguns, in a manner that will allow maximum visibility of each individual gun, and utilize a minimum of shelf space per gun. This display stand is intended to be used in firearms dealers', or collectors', showcases, or on a shelf or table at a gun show or exhibition.

My display is designed to be free-standing, on any flat surface, and allows the handguns to be displayed directly adjacent to one another, yet affords an almost unobstructed view of each individual gun.

My display has a small rectangular slot at each end, designed to interlock with additional units of the same, thereby allowing usage in showcases, or on shelves, of different lenghts. My handgun display stand can be constructed of clear plastic to allow an unobstructed view of the guns.

My handgun display has a large multiangular slot, in each handgun positioning section, designed to support a handgun in the area of the trigger guard, allowing the gun to lean slightly to the left, when viewed from the front, or barrel end, which I believe affords the best viewing angle, as most handguns are manufactured for right-handed people, with most of the controls, (safeties, magazine release, cylinder release, etc.), on the left side of the gun.

My display stand has an angular support bend near each handgun trigger guard recieving slot, designed to support the stand on any flat surface. Additionally, said support bends are designed to force the display to run diagonally, affording a better view of the left side of each handgun displayed, and allowing handguns with longer overall lengths to be displayed on narrower shelves.

My invention is put to use by placing it on a shelf, table top, or any flat surface, then placing the handguns in the multiangular slots. The guns will then be supported by the display at the trigger guard and the frame area near the trigger. Any additional support needed for the guns will be supplied by the shelf or table top.

My display stand invention is designed in a manner that the butt of short barreled handguns will rest on the shelf or table, where they are being displayed. Handguns with longer barrels will lean forward of the display stand, resting their barrels on the shelf or table, where they are being displayed.

My invention allows sufficient room under the trigger guard recieving slot to attach an adhesive label directly under each handgun, stating model, price, or other pertinent information.

My handgun display invention can be manufactured with any number of handgun positioning sections, although the accompanying drawings show positioning sections for three handguns.

As shown in the previous paragraphs, and in the following description and drawings, my invention:

(a) allows a better view of the working parts of handguns;
(b) creates less handling by prospective buyers;
(c) conserves space;
(d) has an area for attaching pertinent information; and
(e) is expandable to fit different situations.

DRAWINGS

The following description and the accompanying three drawing sheets will further disclose my hangun display invention.

Figure 1:
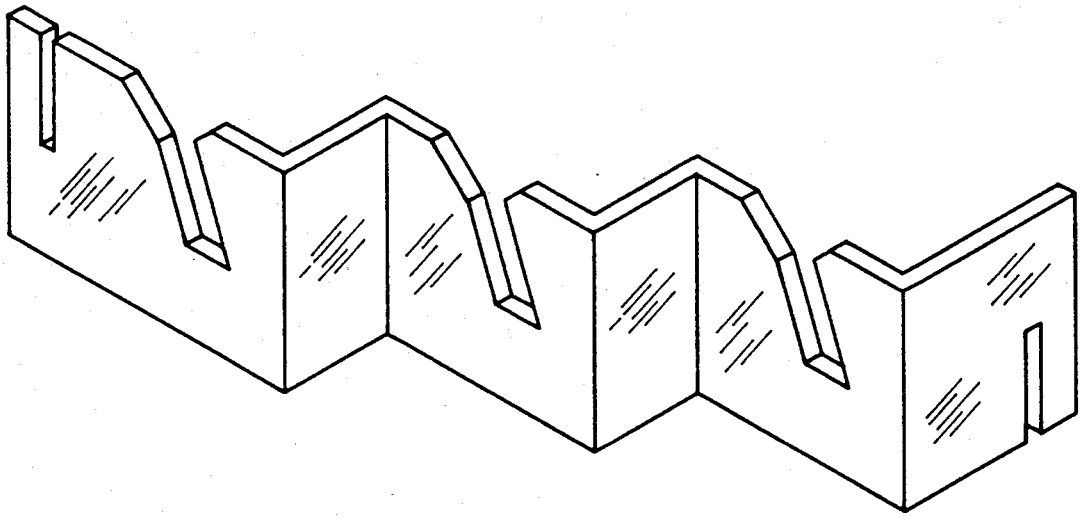
FIG. 1 is a perspective view of my handgun display.
Figure 2:
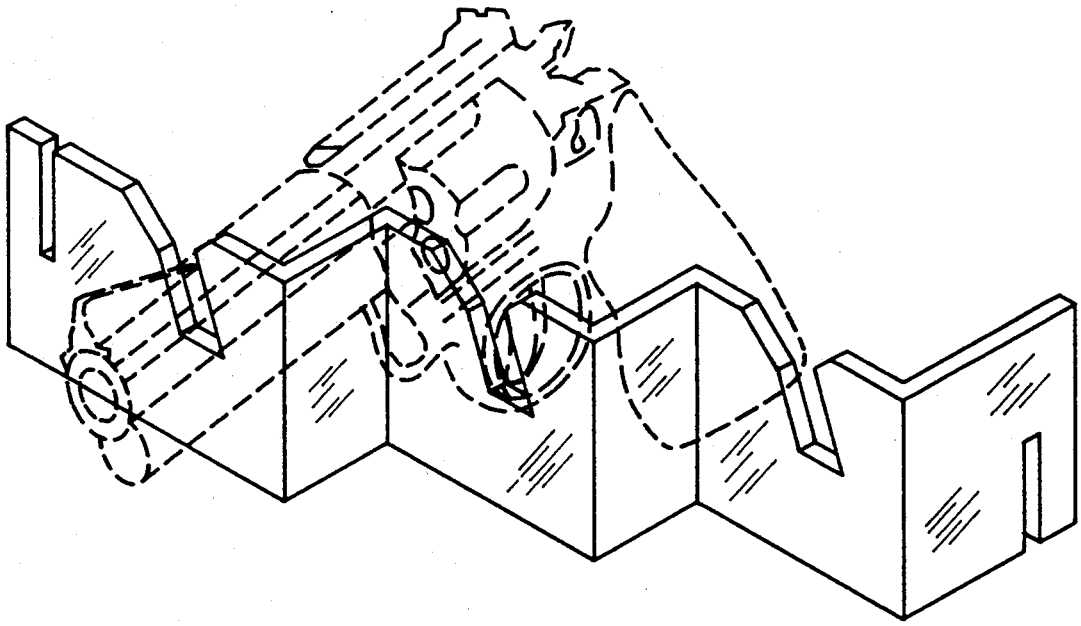
FIG. 2 is another perspective view of my handgun display with the outline of a handgun in the display, as it would appear.

| Reference Numerals used in Drawings | |
|---|---|
| 10 right unit expansion slot | 11 left unit expansion slot |
| 12 trigger guard recieving slot | 13 support bend |
| 14 long handgun positioning section | 15 unit support section |
| 16 handgun positioning section | 17 unit support section |
| 18 handgun positioning section | 19 long unit support section |

DESCRIPTION—FIGS. 3, 4, AND 5

My handgun display invention can be manufactured simply by cutting strips of a plastic type compound, cutting slots 10, 11, and 12, then crealing bends 13 by strip heating. The display can also be manufactured using conventional moulding and vacuum forming techniques.

Figure 3:
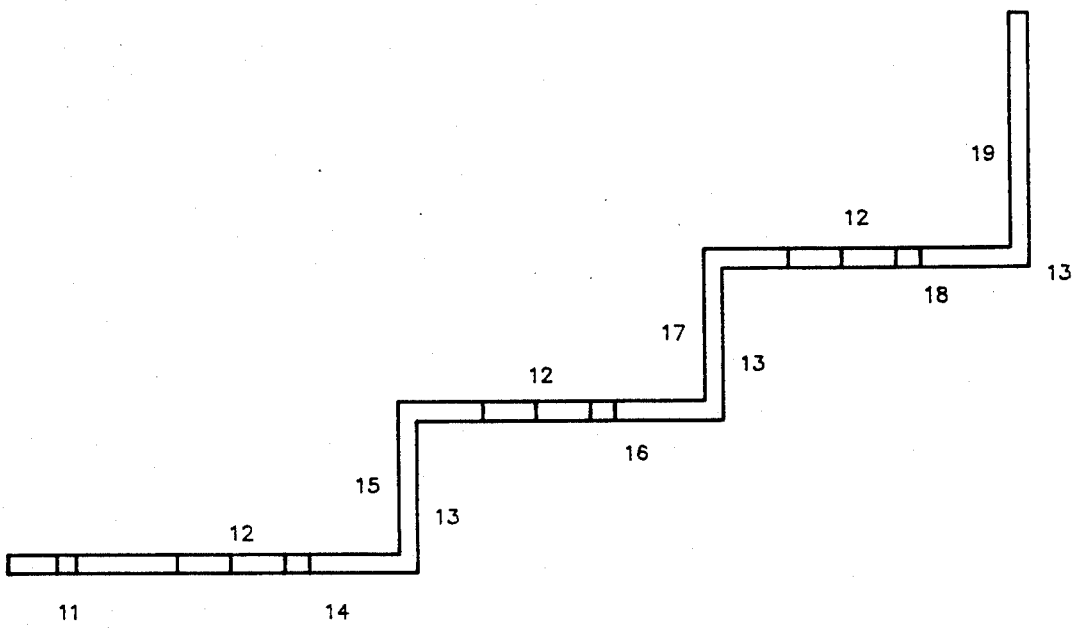
FIG. 3 is a top view of the display.
Figure 4:
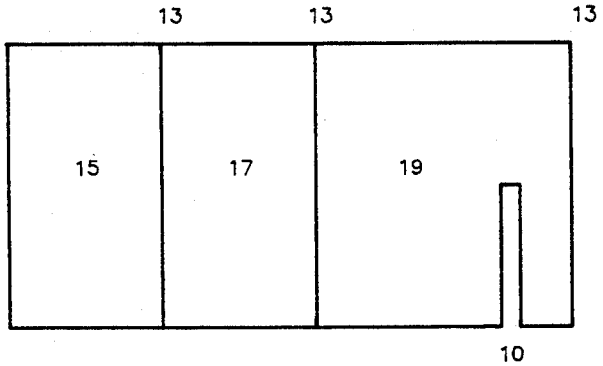
FIG. 4 is a side elevation view.
Figure 5:
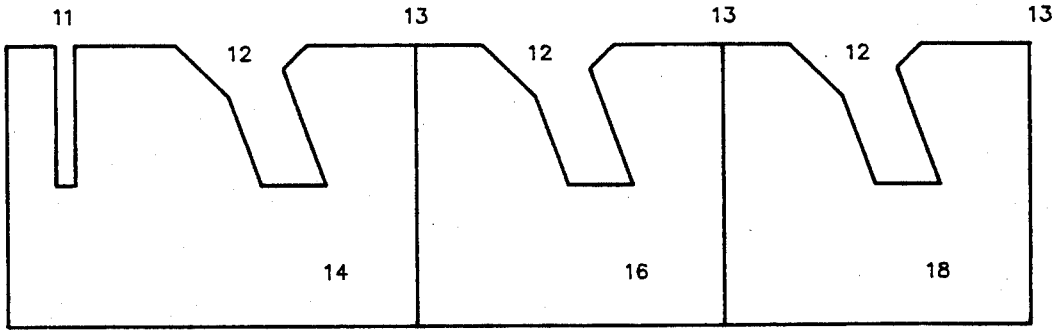
FIG. 5 is a front elevation view.

As shown in FIGS. 3 through 5, unit expansion slot 10, of the invention, can be mated with a unit expansion slot 11, of another handgun display of the same, allowing as many additional units of the same to be attached, as desired.

The trigger guard recieving slots 12, are angled to the left of the vertical plane, when the display is viewed from the front, to tilt the handguns for better viewing. The long handgun positioning section 14, is of greater length than sections 16 and 18, to perpetuate continuity as additional handgun display units of the same are attached.

The display stand unit support sections 15, 17, and 19 are created by bends 13, at angles perpendicular to the handgun positioning sections. The long unit support section 19, is of a greater length than the unit support sections 15 and 17, to add additional support to the display, and to perpetuate continuity as additional handgun display units of the same are attached.

I claim:

1. A stand for displaying handguns, constructed from a single piece of plastic material, said material being bent or moulded into relatively right angles to form one or more rectangular shaped handgun positioning sections, each said handgun positioning section having a trapezoidal shaped slot to recieve therein the trigger guard and adjacent frame area of a handgun, and two or more rectangular unit support sections.

2. The display of claim 1 wherein each said trapezoidal shaped slot extends approximately halfway from the top of the display toward the bottom of the display, and is of a width slightly greater than the trigger guards of most handguns.

3. The display of claim 1 wherein said display has a narrow rectangular slot at each end, one said rectangular slot extending downward from the top of said display halfway to the bottom, the other said rectangular slot extending upward from the bottom of said display halfway to the top, to interlock with additional units of the same.

* * * * *